US006138569A

United States Patent [19]

McCormick

[11] Patent Number: 6,138,569

[45] Date of Patent: Oct. 31, 2000

[54] SINGLE-PLY IMPRINTABLE RECEIPT AND METHOD OF IMPRINTING A RECEIPT

[75] Inventor: Joseph A. McCormick, Manhattan, Ill.

[73] Assignee: General Credit Forms, Inc., Earth City, Mo.

[21] Appl. No.: 08/943,897

[22] Filed: Oct. 3, 1997

[51] Int. Cl.[7] ..... B41E 13/24

[52] U.S. Cl. ..... 101/483; 101/491; 101/492; 462/28; 428/337

[58] Field of Search ..... 400/587, 531, 400/591, 190, 586, 588, 592, 594, 594.1, 606, 241.1; 101/485, 483, 227, DIG. 29, 492, 493, 473; 462/58; 503/204; 428/334, 335, 336, 337, 338

[56] References Cited

U.S. PATENT DOCUMENTS

| | | | |
|---|---|---|---|
| 1,448,601 | 3/1923 | Smith | 400/594.1 |
| 2,610,921 | 9/1952 | Ehrlich | 101/DIG. 29 |
| 2,803,579 | 8/1957 | Stolle et al. | 400/241.1 |
| 3,857,720 | 12/1974 | Fellows | 101/473 |
| 3,890,893 | 6/1975 | Kodis | 101/227 |
| 3,934,069 | 1/1976 | Atzrott et al. | 428/323 |
| 3,965,820 | 6/1976 | Spradlin | 101/485 |
| 3,981,523 | 9/1976 | Maalouf | 282/27.5 |
| 4,139,218 | 2/1979 | Davis et al. | 282/27.5 |
| 4,143,890 | 3/1979 | Davis et al. | 282/27.5 |
| 4,421,428 | 12/1983 | Noda et al. | 400/606 |
| 4,533,567 | 8/1985 | Marinelli | 427/150 |
| 4,614,363 | 9/1986 | Breen | 282/22 R |
| 4,675,063 | 6/1987 | Meek et al. | 400/241.1 |
| 4,703,335 | 10/1987 | Matsushita et al. | 503/204 |
| 4,925,213 | 5/1990 | Anderson | 282/12 A |
| 4,936,605 | 6/1990 | Kifer | 400/531 |
| 5,047,384 | 9/1991 | McCormick | 503/226 |
| 5,088,961 | 2/1992 | Sprain | 462/2 |
| 5,127,880 | 7/1992 | Bar et al. | 482/18 |
| 5,137,494 | 8/1992 | Schubert et al. | 462/68 |
| 5,154,668 | 10/1992 | Schubert | 462/25 |
| 5,197,922 | 3/1993 | Schubert | 462/2 |
| 5,199,924 | 4/1993 | Fitzgibbons | 462/26 |
| 5,209,698 | 5/1993 | Dolan | 462/17 |
| 5,224,897 | 7/1993 | Linden et al. | 462/24 |
| 5,248,279 | 9/1993 | Linden et al. | 462/8 |
| 5,346,430 | 9/1994 | Baxter | 462/2 |
| 5,393,265 | 2/1995 | Linden et al. | 462/24 |
| 5,395,288 | 3/1995 | Linden et al. | 462/18 |
| 5,688,057 | 11/1997 | Wright et al. | 400/188 |

FOREIGN PATENT DOCUMENTS

| | | | |
|---|---|---|---|
| 3435374 | 4/1986 | Germany | 400/531 |
| 2159 | 1/1911 | United Kingdom | 400/591 |

OTHER PUBLICATIONS

"Double Sided Printer" IBM Technical Disclosure Bulletin vol. 24, Noila, Jun. 1981 pp. 22–23.

English language translation of German Unexamined Patent Application No. DE 34 35 374 A1.

*Primary Examiner*—Eugene Eickholt

*Attorney, Agent, or Firm*—Marshall, O'Toole, Gerstein, Murray & Borun

[57] ABSTRACT

An apparatus and method is provided for printing and imprinting duplicates of a credit card receipt using a roll of single-ply paper. The paper may be coated on a first side with a heat-sensitive image producing agent and is coated on a second side with a carbon-type image producing agent. To include transaction information printed on the credit card receipt as well as information written on the receipt by the customer (such as a signature and an indication of the amount of any gratuity), the transaction information is substantially duplicated in two separate fields each on a separate portion of the credit card receipt. At least part of the two separate portions are then aligned and presented to the customer for completion. The two separate portions can be aligned by separating the two separate portions from one another and stacking the two separate portions one upon the other.

3 Claims, 1 Drawing Sheet

SINGLE-PLY IMPRINTABLE RECEIPT AND METHOD OF IMPRINTING A RECEIPT

CROSS-REFERENCE TO RELATED APPLICATION

This contains subject matter related to that of commonly assigned U.S. application Ser. No. 08/774,532 filed Dec. 30, 1996, now U.S. Pat. No. 5,819,665 the entire disclosure of which is hereby incorporated by reference.

BACKGROUND OF THE INVENTION

1. Field of the Invention

The invention is directed generally to a paper roll defining an imprintable form typically used to record retail sales transactions and a method for using the paper roll. More specifically, the invention is directed to a paper roll containing a single-ply paper coated with a material (e.g., a carbon-type coating) that is partially or fully transferrable to a surface of a second portion of paper that is in contact with the coated surface of the single-ply paper and that can be used for printing duplicate, sequential documents, such as credit card receipts.

2. Description of Related Technology

Carbonless papers are papers coated with carbonless image producing agents. The phrase "carbonless image producing agents," as used herein, includes any system of colorless agents that chemically react to form a color when placed in contact with another reactive agent.

Such carbonless image producing agents generally comprise a two-part system. One part of such a system includes chemically reactive, colorless dyes that are contained in rupturable microcapsules. The other part of such a system includes a coatable reactive resin which reacts on contact with the colorless dye to develop a visible color.

To produce an image with such a two-part system, a surface of a first paper is coated with the microencapsulated colorless dyes while a surface of a second paper is coated with the reactive resin. To produce an image, the coated surfaces of the first and second papers are brought together and pressure sufficient to rupture the microcapsules is applied. When the microcapsules rupture, the colorless dyes are released and react with the reactive resin to form an image on the surface of the resin coated paper. Thus, the image printed or written on the first paper is also imprinted on the second paper.

Another type of carbonless image producing agents comprises paper having at least one side coated with self-contained (SC) microencapsulated colorless dyes and reactive resins. SC coated paper can be used to create an image, for example, by printing on an uncoated or coated sheet that is stacked upon the SC coated paper.

Image transfer processes using carbonless paper or using paper coated with a carbon-type image producing agent will be hereinafter referred to generally as "printing/imprinting." Typing or writing directly onto paper will be hereinafter referred to generally as "printing." Copying an image using carbonless paper or using paper coated with a carbon-type image producing agent will be hereinafter referred to generally as "imprinting."

Carbonless, multiple ply business forms generally include a number of plies that provide a desired number of copies of the form. For two-ply forms, the top ply is most often a coated back ("CB") paper and the adjacent underlying ply is a coated front ("CF") paper. In such a two-ply form, the CB paper is treated with a carbonless coating that contains rupturable microcapsules that are filled with reactive, colorless dyes. The CF paper is treated with a resin adapted to react with the colorless dyes. When the microcapsules are ruptured to allow contact of the colorless reactive dyes with the resin, a color changing reaction occurs that produces an image on the CF sheet of the underlying ply.

Multiple ply forms having three or more plies can also include a coated front and back ("CFB") ply. For example, in a three-ply form, the top ply may be a CB ply, the middle ply may be a CFB ply, and the bottom ply may be a CF ply. The middle (CFB) ply is coated on both opposing surfaces such that the CF surface of the middle ply allows images to be made on the middle ply and the CB surface of the middle ply allows copies of such images to be made on the CF bottom ply.

Conventionally, the bottom surfaces of CB paper are coated with the microencapsulated colorless dyes, and the top surfaces of CF paper are coated with the reactive resin. In addition, CFB paper is coated on one surface with the reactive resin and on the opposing surface with the microencapsulated dyes.

Carbonless papers coated with such carbonless image producing agents that are suitable for use in the invention are described in U.S. Pat. No. 3,981,523, for example, the disclosure of which is incorporated herein by reference. Other commercially available carbonless papers are sold under the trademark NCR PAPER®, by Appleton Paper Inc. of Appleton, Wis. Compatible carbonless papers are also produced by other manufacturers such as Moore Business Forms, 3M, Mead Paper and others.

One common continuous feed printing/imprinting system that produces variable sized and shaped forms or copies from a common feedstock is a "point of sale" printing/imprinting system. Such systems are commercially available from manufacturers such as VeriFone Inc., Hypercom, Inc. and Datacard Corp. Retail sales transactions using credit cards are typically recorded on continuously fed two-ply (or sometimes three-ply) carbonless paper rolls using standardized printing/imprinting equipment. As used herein, the term "credit cards" is understood to include credit cards, debit cards, or other similar means for transferring funds between parties. A two-ply carbonless paper roll having one ply stacked or layered on the other ply readily provides two copies of the sale. The top ply is printed by a printer and the printed image is imprinted on the bottom ply due to the carbonless coating or coatings.

Specifically, in a "point of sale"transaction, a customer's credit card having a magnetic information strip is passed through a magnetic reader. Information, such as the customer's name, account number, card expiration date, etc., is read from the magnetic strip and this information is then printed/imprinted onto a multiple-ply carbonless paper roll. At the same time, additional information related to the specific sale, such as merchant's name, items purchased, price, etc., is also printed/imprinted onto the paper roll. After all of the needed information is printed/imprinted and each ply of the paper roll contains a copy thereof, a sales clerk separates the printed/imprinted portion of the paper roll from the remainder of the paper roll. The separated, printed/imprinted portion of the roll, which varies in length from sale to sale, is presented to the customer for completion, for example, in a restaurant setting, by signing the printed/imprinted portion and indicating thereon the amount of any gratuity and the total amount. Then, the two or more plies of the printed/imprinted portion are usually separated from one another by the sales clerk and separate copies containing complete copies of the printed/imprinted statement are retained by the sales clerk and the customer, respectively. Usually, the clerk keeps the printed top ply and the customer keeps the imprinted bottom ply.

More recently, "point of sale" printing systems have been developed that use a paper roll containing a single ply of plain (uncoated) bond paper (having no imprintable second ply) or containing a single ply of thermal paper (i.e., having a heat-sensitive image producing agent coated on the top surface thereof). Such single-ply "point of sale" systems are commercially available from manufacturers such as NCR, Micros Systems Inc., Datacard, and Citizen. In order to generate separate copies of the printed statement, two or more copies of the transaction information are printed. Typically, two copies of the transaction information are printed sequentially on paper fed from a single-ply, uncoated bond paper roll or from a single-ply thermal paper roll.

If desired, additional copies of the transaction information may also be printed on one or more remote printers. For example, in a restaurant setting, a copy of the transaction information may be printed on a printer located in a kitchen, to facilitate the preparation of food and/or beverages ordered through the transaction.

In the above settings, such as in the restaurant setting, when the customer (i.e., the credit card holder) is to complete a printed statement, the customer typically signs the statement and also indicates the amount of any gratuity and the total amount on the statement that is given to the clerk or to the waiter. However, when duplicates of the statement are printed sequentially, the customer typically keeps the unsigned copy, forgetting to record the amount of the gratuity, if any, that the he or she had written on the statement given to the clerk or to the waiter. Such a sequence of events can lead to problems, as it can facilitate fraudulent indications of an inflated gratuity. Rightfully or mistakenly, the customer may dispute the total charged to the credit card account that is reflected on a statement or bill from the credit card issuer, as reflecting a higher gratuity amount than that which was actually authorized by him or her. As a result, the restaurant is often faced with a "charge back" of the disputed amount and that amount must be credited to the credit card issuer account at least for an interim period until the matter is resolved. One restaurant chain alone has found this to be a problem costing the chain approximately one million dollars per year. As the single-ply receipt "point of sale" systems proliferate, such "charge backs" could potentially translate into hundreds of millions of dollars in lost revenues on an industry-wide basis.

Also, because of the high cost of fraud, due to collusion among customers and merchants, the credit card issuers often require that an imprint of the credit card be on the sales slip with the total and signature or the charge back is allowed. This is impossible with existing single-ply plain bond paper or thermal paper receipts.

As disclosed in commonly assigned U.S. application Ser. No. 08/774,532, single-ply carbonless receipts can be used to overcome the aforementioned "charge back" problem. However, carbonless materials cannot be used in some situations. For example, carbonless coatings are incompatible with thermal paper. Accordingly, there is a need for single-ply receipts for printing/imprinting utilizing coatings other than carbonless coatings.

SUMMARY OF THE INVENTION

It is an object of the invention to overcome one or more of the problems described above.

According to the invention, an imprintable receipt roll includes a single ply of wound paper having at least one surface coated with a carbon-type image producing agent.

The invention also provides a method for printing/imprinting a receipt, including the steps of: providing the inventive receipt roll of paper; printing first and second substantially identical fields of information on first and second portions of a surface of the paper; separating the first and second portions from the roll; aligning at least part of the first and second portions; and presenting the first and second portions of paper to a customer for completion.

Other objects and advantages of the invention will be apparent to those skilled in the art from a review of the following detailed description taken in conjunction with the drawings and the appended claims.

DETAILED DESCRIPTION OF THE INVENTION

The invention provides a single-ply coated paper roll coated with a carbon-type image producing agent, suitable for use in "point of sale" printing equipment.

As used herein, the term "carbon-type image producing agent" is understood to include any coating material that, when coated on a surface of a first portion of paper, is partially or fully transferrable to a surface of a second portion of paper that is in contact with the coated surface of the first sheet of paper (i.e., due to pressure applied by writing or typing on the first sheet of paper), including, but not limited to, waxy pigmented ink coating materials that may be applied to a bottom surface of a first sheet of paper in order to transfer a written or typed mark onto a top surface of a second sheet of paper placed directly below the first sheet of paper, due to the pressure applied by writing or typing on a top surface of the first sheet. Although carbon-type image producing agents commonly produce a black image (e.g., by including carbon black in the agent), other colors can be produced, such as red, blue, or gray, by varying the formulation of the carbon-type image producing agent in a manner well known in the art.

Figure 1:
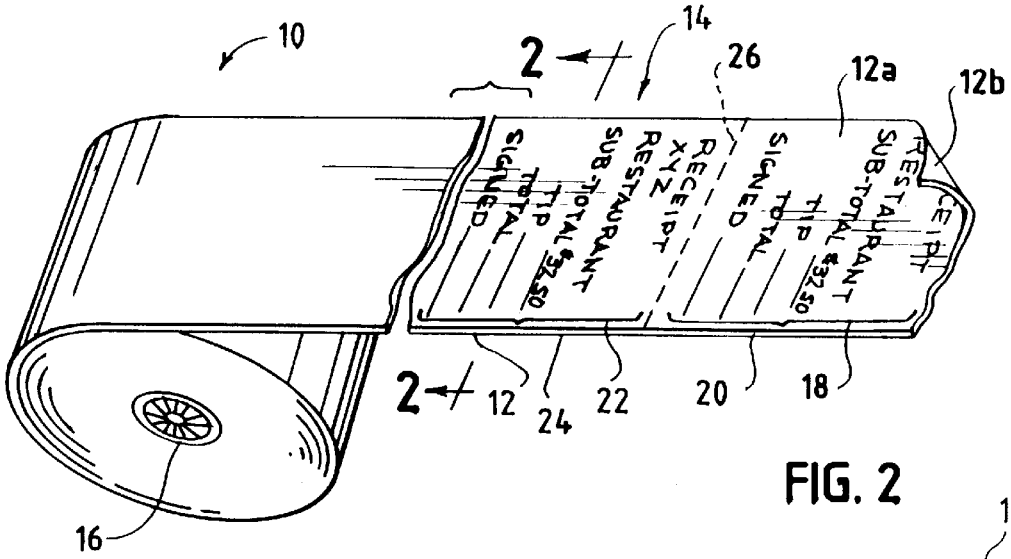
FIG. 1 is a perspective fragmentary view of an imprintable credit card receipt roll in accordance with the invention.

As illustrated in FIG. 1, a single-ply paper roll, generally designated 10, includes a single paper ply 12 having a first or upper surface 12*a* and a second or lower surface 12*b*. A typical roll 10 is approximately three inches wide with the outside diameter of a wound roll 10 being approximately 2½ to 3½ inches. The size of the roll 10 can vary depending upon a particular application. The paper ply 12 defines an imprintable credit card receipt form, generally designated 14. The paper ply 12 is wound about a core, illustratively a plastic or fiber spool 16. Transaction information is printed on the upper surface 12*a* in a first field of information 18 on a first portion 20 of the paper ply 12. Substantially the same transaction information is also printed in a second field of information 22 on a second portion 24 of the paper ply 12.

Figure 2:
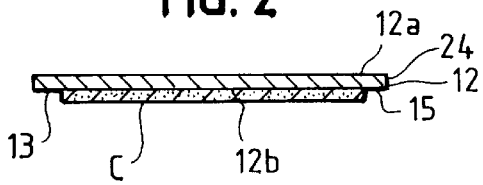
FIG. 2 is a cross-sectional view, taken along lines 2—2 of FIG. 1, of a paper ply coated with a carbon-type image producing agent in accordance with the invention.

As illustrated in FIG. 2, the surface 12*b* is coated with a carbon-type image producing agent, designated "C" herein, which is preferably a "smudge-free carbon" formulation. The paper ply 12 is thus what is commonly referred to as a carbon-on-back (COB) slip. Edge portions 13 and 15 of the surface 12*b*, each having a width of about one-eighth of an inch, are not coated with the carbon-type image producing agent "C." Such so-called "clean edges" at edge portions 13 and 15 are preferred in order to avoid discoloration that would otherwise occur at the edges of the roll 10, when the roll 10 is cut to its final size from a larger roll (not shown) during manufacturing of the roll 10.

Figure 2A:
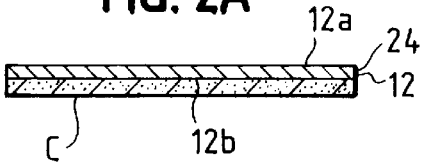
FIG. 2A is a cross-sectional view, similar to that of FIG. 2, of a paper ply coated with a carbon-type image producing agent over the entire width of the paper ply.

As shown in FIG. 2A, the carbon-type image producing agent "C" can cover the entire width of the paper ply 12. However, such an arrangement is less preferred, due to the potential for discoloration at the edges of the roll 10, as noted above in connection with FIG. 2.

Figure 3:
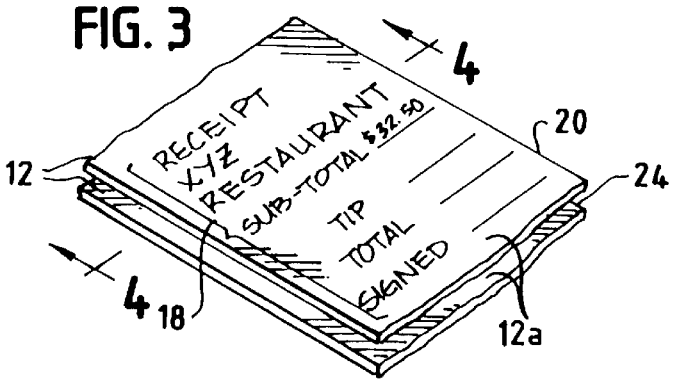
FIG. 3 is a perspective view of separated, stacked, and aligned first and second portions of a paper ply coated with a carbon-type image producing agent in accordance with the invention.

FIG. 3 shows the paper ply 12 wherein the first and second portions 20 and 24, respectively, have been separated from one another and the first portion 20 has been aligned with and stacked upon the second portion 24.

Figure 4:
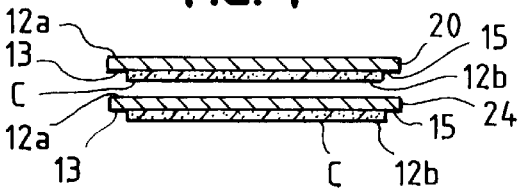
FIG. 4 is a cross-sectional view, taken along lines 4—4 of FIG. 3, of the paper ply in accordance with the invention.

FIG. 4 shows, in cross section, the paper ply 12 of FIG. 3.

The following procedure is used for completion of the credit card receipt form 14. After the transaction information has been printed on the upper surface 12*a*, the first and second portions 20 and 24, respectively, are separated from one another and the first portion 20 is aligned with and stacked upon the second portion 24, as seen in FIG. 3. (The separation of the first and second portions 20 and 24 may be accomplished, for example, by cutting the paper automatically, or by tearing the paper manually.) Then, the customer completes the credit card receipt form 14, for example, by indicating, on the first portion 20, the amount of any gratuity, and the total amount resulting from any gratuity, and by signing the credit card receipt form 14. The information written on the first portion 20 is transferred to the second portion 24, beneath the first portion 20, due to the carbon-type image producing agent coated on the surface 12*b* of the paper ply 12.

Although the first portion 20 is shown in FIG. 3 to be substantially completely aligned with the second portion 24, the invention may be practiced even if only part of the first portion 20 is aligned with only part of the second portion 24, so long as there is sufficient overlap to ensure that information written on the first portion 20 will be imprinted on the second portion 24. Also, it should be noted that, instead of aligning and stacking the first portion 20 upon the second portion 24, the second portion 24 may be aligned with and stacked upon the first portion 20 without altering the result achieved by using the invention.

Figure 5A:
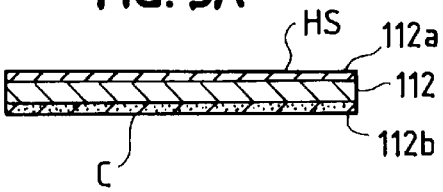
FIG. 5A is a cross-sectional view, similar to that of FIG. 5, of a paper ply coated on a first side with a heat-sensitive image-producing agent and coated on a second side with a carbon-type image producing agent over the entire width of the paper ply.
Figure 5:
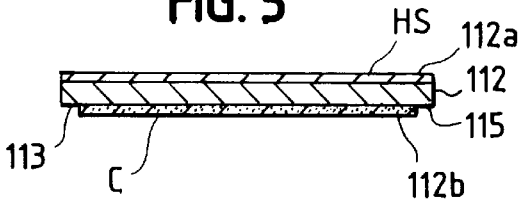
FIG. 5 is a cross-sectional view, similar to that of FIG. 2, showing an alternative embodiment of the invention in which a paper ply is coated on a first side with a heat-sensitive image-producing agent and coated on a second side with a carbon-type image producing agent.

FIG. 5 illustrates an alternative embodiment of the invention, in which a paper ply 112 includes a first or upper surface 112*a* coated with a heat-sensitive image producing agent, designated "HS" herein. Such a paper ply 112 coated with a heat-sensitive image-producing agent is available commercially from Appleton Paper Inc. of Appleton Wis., under the trademark OPTIMA® (grade: "POS"). A second or lower surface 112*b*, opposed to the upper surface 112*a*, is coated with a carbon-type image producing agent, designated "C" herein. Edge portions 113 and 115 of the surface 12*b* are not coated with the carbon-type image producing agent "C," for the same reasons as noted above with regard to the edge portions 13 and 15 shown in FIG. 2. Commercial carbon ink coating services, such as FRYETECH, located at 801 S. 21st Street, Parsons, Kans. 67357, can readily coat thermal paper with a carbon-type image producing agent "C."

As shown in FIG. 5A, the carbon-type image producing agent "C" can cover the entire width of the paper ply 112. However, such an arrangement is less preferred, due to the potential for discoloration at the edges of the roll 10, as noted above in connection with FIG. 2.

In the embodiment of FIG. 5, a procedure is used for completion of the credit card receipt form 14 that is essentially identical to that described above with regard to the first embodiment. After the transaction information has been printed on the upper surface 112*a*, the first and second portions 20 and 24, respectively, are separated from one another, and the first portion 20 is aligned with and stacked upon the second portion 24, as seen in FIG. 4. (The separation of the first and second portions 20 and 24 may be accomplished by cutting the paper automatically, or by tearing the paper manually, for example.) Then, the customer completes the credit card receipt form 14 as, for example, by indicating, on the first portion 20, the amount of any gratuity, and the total amount resulting from any gratuity, and by signing the credit card receipt form 14. The information written on the first portion 20 is transferred to the second portion 24, beneath the first portion 20, due to the carbon-type image producing agents on the paper ply 112, namely, the coating of the lower surface 112*b* with the carbon-type image producing agent "C."

It should be noted with regard to either of the foregoing embodiments that additional portions, similar or identical to the first and second portions 20 and 24 can be stacked beneath the first and second portions 20 and 24, if desired, for example, in order to provide a third copy of all or part of the transaction information.

The step of aligning at least part of the first and second portions of paper may comprise a step of separating the first portion of paper from the second portion of paper and a step of stacking the first and second portions of paper one upon the other.

Although not shown in the drawings, if desired, a protective cover sheet can be included beneath the lower surface 112*b*, similar to the cover sheet disclosed in U.S. Pat. No. 4,903,989, the entire disclosure of which is hereby incorporated by reference. Such a cover sheet could serve to protect moving parts of printing machinery from being fouled by contact with the carbon-type image producing agent "C" on the lower surface 112*b*, or as protection from carbon imprinting from the bottom ply of the stacked plies getting on a tablecloth in a restaurant.

The invention obviates the problems or disadvantages sometimes associated with the prior art while at the same time achieving the desired features for accurately recording transactions when a roll of single-ply paper is used to generate a receipt. This is accomplished by ensuring that both the merchant and the customer retain a contemporaneous record of information written on the receipt by the customer.

The foregoing detailed description is given for clearness of understanding only, and no unnecessary limitations should be understood therefrom, as modifications within the scope of the invention will be apparent to those skilled in the art.

What is claimed is:

1. An imprintable receipt roll comprising:

a single ply of wound paper forming a roll, the single ply of paper having at least one surface coated with a carbon-type image producing agent, the carbon-type image producing agent comprising a coating material that, when coated on the at least one coated surface, is partially or fully transferrable to a surface of a second portion of paper that is in contact with the at least one coated surface in order to transfer a written or typed mark onto a top surface of the second portion of paper, due to the pressure applied by writing or typing on the printable surface, wherein a first surface of the single ply of paper is coated with a heat-sensitive image producing agent and a second, opposed surface of the single ply of paper is coated with the carbon-type image producing agent.

2. A method for printing/imprinting a receipt, the method comprising the steps of:

providing a single ply roll of paper having at least one surface coated with a carbon-type image producing agent;

printing a first field of information on a first surface of the paper on a first portion of the paper;

printing a second field of information, substantially identical to the first field of information, on said first surface on a second portion of the paper;

separating the first and second portions of paper from the roll;

at least partially aligning the first and second portions of paper; and presenting the first and second portions of paper to a customer for completion.

3. The method of claim 2, wherein the step of at least partially aligning the first and second portions comprises a step of separating the first portion of paper from the second portion of paper and a step of stacking the first and second portions of paper one upon the other.

* * * * *